United States Patent [19]

Castillo

[11] 4,139,123

[45] Feb. 13, 1979

[54] SINGLE PUMP RECIRCULATING CARBONATOR

[75] Inventor: Herman B. Castillo, Clawson, Mich.

[73] Assignee: Alco Foodservice Equipment Company, Miami, Fla.

[21] Appl. No.: 784,224

[22] Filed: Apr. 4, 1977

[51] Int. Cl.[2] ..... B67D 5/56

[52] U.S. Cl. ..... 222/56; 222/129.1; 222/318

[58] Field of Search ..... 222/56, 57, 64, 67, 222/145, 318, 129.1, 129.2; 251/63.4; 137/386, 409, 434, 565

[56] References Cited

U.S. PATENT DOCUMENTS

| | | | |
|---|---|---|---|
| 2,455,681 | 12/1948 | Kantor et al. | 222/57 X |
| 3,147,772 | 9/1964 | Stelzer et al. | 251/63.4 X |
| 3,394,847 | 7/1968 | Garrard | 222/57 X |
| 3,731,845 | 5/1973 | Booth | 222/318 X |
| 3,737,602 | 6/1973 | Bueler | 251/63.4 X |
| 3,809,292 | 5/1974 | Booth et al. | 222/129.1 X |

*Primary Examiner*—Stanley H. Tollberg
*Assistant Examiner*—Fred A. Silverberg
*Attorney, Agent, or Firm*—Haight, Hofeldt, Davis & Jambor

[57] ABSTRACT

A recirculating carbonator and beverage dispenser requires only one pump. The system's function can be enhanced by the use of a two position spool valve having a fresh water inlet port, a carbonated water inlet port, and a fluid outlet port commonly connected with a central bore. A spool member is slidably disposed within the bore to selectively interrupt fluid communication between the carbonated water inlet port and the liquid outlet port during the presence of a low water signal generated by a level sensing device within the system's carbonation tank. During the interruption, fresh make-up water is added to the system.

5 Claims, 4 Drawing Figures

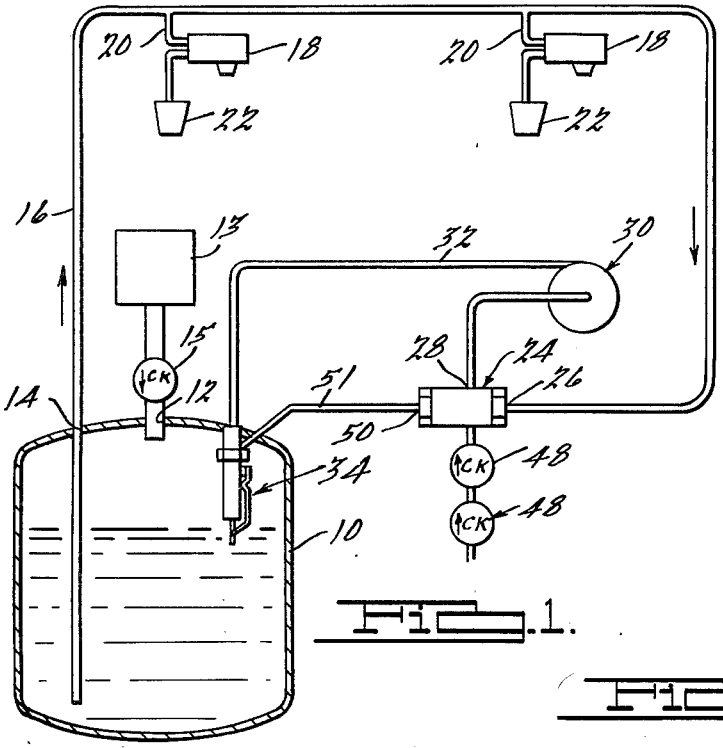
FIG. 1.
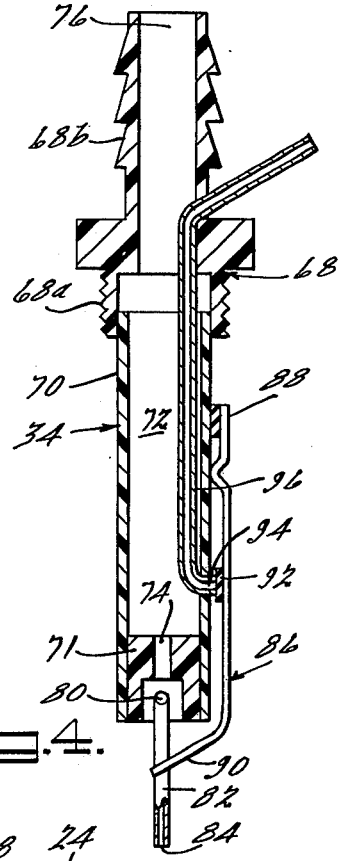
FIG. 4.
FIG. 2.
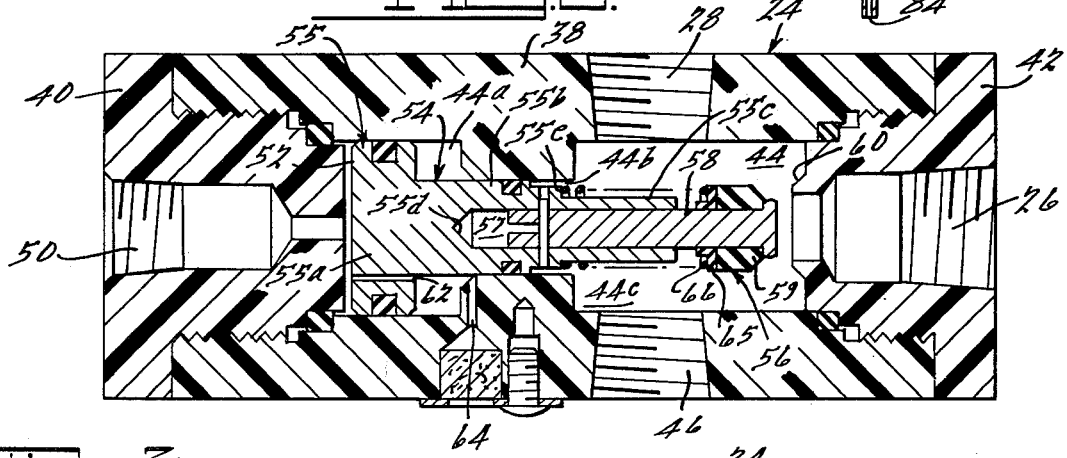
FIG. 3.
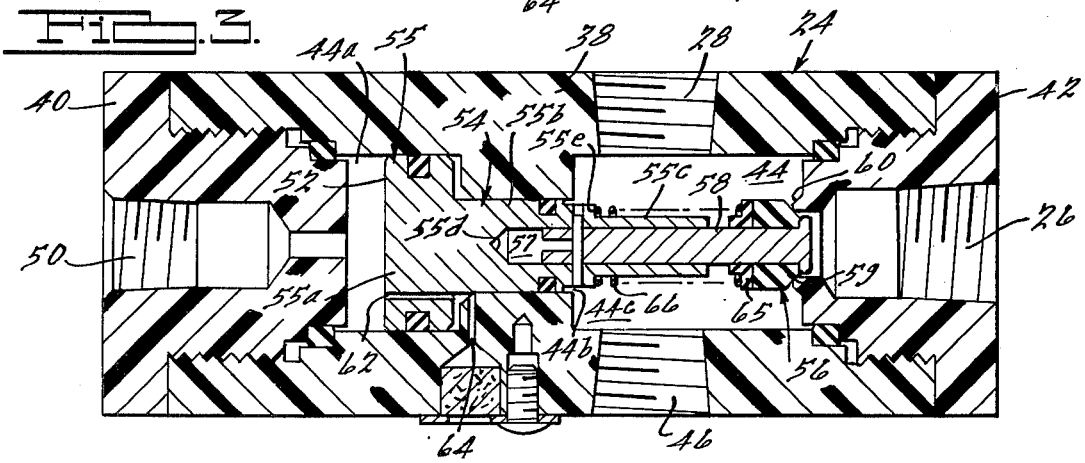

SINGLE PUMP RECIRCULATING CARBONATOR

BACKGROUND OF THE INVENTION

1. Field of the Invention

In one aspect, this invention relates to carbonator systems.

In a further aspect, this invention relates to valves which control the recirculation of carbonated water within a beverage system and the admission of fresh makeup water to the system.

2. Description of the Prior Art

Present recirculating carbonator systems constantly draw carbonated water from a storage tank, cycle the water past a beverage dispensing head into a pump, and return the water to the storage tank in a closed loop. Such systems normally use two pumps. One pump is used to recirculate the carbonated water throughout the system, and the second pump is used to force makeup fresh water into the storage tank for carbonation. The use of two pumps adds additional expense and maintenance problems to the present recirculating system.

To overcome this problem, a one pump recirculating system was developed. This existing single pump recirculating system utilizes a double diaphragm valve which is spring biased to stay in an open position allowing recirculation during the normal circulating cycle. The valve is closed by means of a fluid amplifier when the liquid level in the storage tank falls below a predetermined level. This momentarily stops the carbonated water recirculation and the recirculating pump draws fresh water into the system through a check valve. The action of the double diaphragm valve is dependent upon the use of the fluid amplifier which channels the carbonated water recycled into the storage tank into a port which is in fluid communication with one side of the diaphragm.

This system depends on a signal generated by a stream of carbonated water directed into an open circuitous passage to activate the diaphragm valve; the valve is then rather insensitive to changes in liquid level within the storage chamber. Also, the activating force can be affected by the line pressure of fresh water to be admitted to the system, such pressures having a wide variation on the order of 20 to 60 psi.

SUMMARY OF THE INVENTION

It is an object of this invention to provide a recirculating system which is less expensive and more maintenance-free than prior art recirculating systems. It is a further object of this invention to provide a system which is relatively immune to variations in the water pressure in the external water source. A further object is to provide an improved single pump recirculating carbonator.

One feature of this invention is the provision of a two-position spool valve within the recirculating carbonated water system. The valve has a valve body with a longitudinal bore. A valve outlet in fluid communication with the bore recycles carbonated water from the recirculating pipe to a storage tank. A recirculating inlet and a fresh water inlet allow water to enter the longitudinal bore. A moveable spool is mounted within the bore. The spool has a first position which simultaneously maintains the outlet, recirculating inlet and fresh water inlet in communication with the bore. Since the pressure at the recirculating inlet is higher than the pressure at the fresh water inlet, the system recycles carbonated water in the first position. When water in the storage tank falls below a predetermined level, the spool moves to a second closed position which blocks the recirculating inlet. A pump which normally recycles carbonated water will draw water from the fresh water inlet through the bore to the outlet and pump the fresh water into the storage tank for carbonation and recycling.

BRIEF DESCRIPTION OF THE DRAWING

In the accompanying drawing:

FIG. 1 discloses schematically a single pump recirculating carbonation system;

FIG. 2 discloses one embodiment of a spool valve adapted to be used within the recirculating system of FIG. 1, the valve being shown in the recirculating mode;

FIG. 3 shows the valve of FIG. 2 in the fill mode; and

FIG. 4 discloses a liquid sensing device adapted to cooperate with the valve of FIGS. 2 and 3.

DETAILED DESCRIPTION OF THE DRAWING

Referring initially to FIG. 1 of the drawing, a tank 10 having an inlet 12 for carbon dioxide is used as a storage tank or reservoir for carbonating and storing water. A suitable carbon dioxide source 13 delivers carbon dioxide to a check valve 15 from whence it enters tank 10 through inlet 12. Carbonated water is withdrawn from the lower portion of tank 10 through a recirculating line 16 which exits tank 10 at outlet 14 and thereafter extends past one or more beverage dispensing heads 18. The beverage dispensing heads 18, when activated, will draw a quantity of carbonated water from the recirculating line 16 via a shunt 20 and simultaneously draw a quantity of beverage syrup from an attached syrup reservoir 22. The carbonated water is kept constantly circulating in line 16 at a constant pressure on the order of 80 to 125 psi. If no carbonated water is withdrawn by a beverage dispensing head, the carbonated water continues through line 16, and passes into the recycling inlet port 26 of a spool valve 24.

From the recycling inlet 26, carbonated water passes through an outlet 28 and into a pump 30, which acts to draw carbonated water through recirculating line 16. The pump 30 discharges the carbonated water from the pump outlet into a line 32 and into the storage tank 10. The carbonated water reenters the tank through a liquid sensing device 34 located within the tank.

It is understood that a cooling mechanism will be used to cool the water at some point as it travels through the recycling line 16. Such cooling mechanisms and their location are old in the art and form no part of this invention. One skilled in the art can easily locate a cooling system which will chill the carbonated water to the desired degree and a discussion of the chilling system is omitted in the interest of brevity.

The spool valve 24 of this invention is shown in greater detail in FIGS. 2 and 3. The valve body is constructed in three parts, a center valve body 38 and two end caps 40, 42 which are threaded into the center valve body to define within the center valve body a shaped longitudinal bore 44. End cap 42 defines the recirculating inlet 26. Water from the recirculating line 16 enters the shaped longitudinal bore 44 of the valve 24 at the recirculating inlet 26. The outlet 28 is disposed in center valve body 38 and provides an exit path from the bore 44 into the intake of pump 30. Liquid entering bore 44 is drawn into the pump and pumped into the storage tank 10. Also in fluid communication with bore 44 is a fresh water inlet 46 defined in center valve body 34 and connected via a double check valve 48 to supply of city water (not shown). The pressure at the recycling inlet 26 normally runs between 80 and 125 psi or higher and the pressure at fresh water inlet 46 is normally about 20 to 40 psi. Therefore, when both inlets 26, 46 are open to the longitudinal bore 44, the higher pressure at the recycling inlet 26 will substantially prevent the influx of fresh water through inlet 46 and the valve can be said to be in a recycling mode as shown in FIG. 2.

At the opposite end of the valve body distal the recycling inlet is an actuation inlet 50 which is defined by end cap 40 and connected to the liquid level sensing means 34 by a line 51 (FIG. 1). A spool assembly 54 is disposed in bore 44. Assembly 54 includes a main body member 55 and a plunger 56. Main body member 55 includes an enlarged end portion 55*a* sealingly and slidably received in end portion 44*a* of bore 44, a central portion 55*b* slidably and sealingly received in a necked down bore portion 44*b*, and an end portion 55*c* disposed centrally within enlarged bore portion 44*c*. A central bore 57 extends through end portion 55*c* and terminates at a blind end 55*d* within central portion 55*b*. Plunger 56 is slidably received in bore 57.

When the liquid level in storage tank 10 falls below a predetermined level, valve 24 is actuated by admitting an actuating fluid through the actuation inlet 50. The fluid pushes against the large end face 52 of valve assembly 54 and drives the plunger 56 into a seated or fill mode position as shown in FIG. 3.

Specifically, an annular sealing washer 59 which is positioned on the face end of plunger 56 moves into engagement with a valve seat 60 defined at the inboard end of recycling inlet 26. This effectively seals the recycling inlet 26 from the shaped longitudinal bore 44. In the fill mode, the pump 30 withdraws water from the longitudinal bore 44 and creates a sufficiently low pressure so that fresh water will enter the longitudinal bore 44 through fresh water inlet 46 and thereby the recirculating system. Fresh water will continue to enter until the liquid level sensing means 34 signals that the liquid level in the storage tank has been restored. At this point, the actuation is stopped and the pressure which was applied to the face 52 of the plunger bleeds through a small bore 62 longitudinally disposed through the face of the plunger and exits from the valve body via a channel 64.

The valve spool 54 is shown as being actuated by a fluid applied via the actuation port 50. Of course, the valve could be actuated by means of a rod or similar well known valve actuation means known in the art. Of course, the spool could be actuated by other means. Examples of well known mechanical actuation devices are solenoids with push rods. Also mechanical or electrical actuation means which move the spool from the recirculating position to the fill position and allow return to the recirculating position.

As shown, the annular radially disposed sealing washer 56 is biased into engagement with the seat 60 by means of a compression helical spring 66. Spring 66 seals at one end on a washer member 65 positioned on plunger 56 adjacent the inboard end of washer 56; the closed end of spring 66 seals adjacent a shoulder 55*e* defined on main body member 55. This particular sealing arrangement provides a means for controlling the water pressure at the dispensing head. As the storage tank 10 fills, carbon dioxide within the tank will be compressed by the water entering the tank. As the carbon dioxide pressure increases, the pressure in the recycling line 16 will correspondingly increase and the pressure at the recycling inlet 26 will rise to 120 psi or more. The spring 66 allows the annular sealing washer 56 to slightly disengage from the mating sealing surface 60 allowing a small quantity of water to leak into the bore 44 relieving the pressure while allowing filling to continue. This feature prevents excessive pressure build up in the recirculating line 16 which would affect the water to syrup ratio at the dispensing head. The pressure at which the spring 66 allows the annular sealing washer to partially release is a matter of choice and those skilled in the art can adjust the spring to provide the desired pressure in a particular system.

Referring to FIG. 4, a liquid level sensing device 34 adapted to be used with the valve of FIGS. 2 and 3 is shown. The sensing device 34 includes a connector 68 having a lower threaded fitting 68*a* for threaded engagement into the inlet of tank 10 and an upper serrated fitting 68*b* for receipt of line 32. A tube 70 is press fit into fitting 68*a* and extends downward therefrom into the storage tank. A plug 71 is fitted into the lower end of tube 70 and defines a restricted outlet 74. Recirculating fluid enters the bore through inlet 76 and passes through the restricted outlet or orifice 74 past the mouth 80 of a venturi tube 82. As the recirculating fluid passes the venturi tube 82, it creates an area of reduced pressure at the mouth 80 of the venturi tube 82. The outer or liquid sensing end 84 of the venturi tube contacts the liquid contained within the storage tank. Fluid from the reservoir will be drawn through the venturi tube 82 and strike the stream of recirculating water as it leaves the restricted outlet 74. This deflects the recirculating stream as it passes the mouth 80 of the venturi 82. As shown, the liquid drawn through the venturi tube 82 will exit from the venturi tube perpendicular to the plane of the drawing and will deflect the stream of recirculating fluid exiting from the restricted outlet 74 out of the plane of the drawing.

A cantilevered arm 86 is rigidly mounted at one end 88 to tube 70 of the sensor 34 and has a curved end 90 which projects into the straight-line path of the recirculating water when there is no water being drawn through the venturi pipe 82. A fluid tube 96 extends within tube 70; tube 96 projects at its upper end through fitting 68*b* for connection to line 51 and projects at its lower end through tube 70 for connection with arm 86. A sealing pad 92 located on the arm 86 normally blocks the entrance end 94 of tube 96. In general, the venturi pipe has its lower or terminus end 84 positioned so that when the storage tank has the desired quantity of carbonated water, the terminus end 84 of the pipe 82 is in the carbonated water. When the water level falls below the desired level, the terminus end of the venturi pipe will be in a carbon dioxide gaseous atmosphere. At this point, no liquid will be drawn through the venturi 82 by the recirculating water, and the recirculating water will strike the hooked end 90 of the cantilevered arm 86. The force of the recirculating water striking the arm will deflect the arm and move the pad 92 away from the inlet end 94 of the fluid tube 96. The $CO_2$ gas normally present in the storage chamber 10 under pressures of approximately 80 to 120 psi or higher will flow freely through the tube 96. Gas exiting from the tube is used as a signal warning that the liquid level in the storage tank is inadequate.

In cooperation with the valve disclosed in FIGS. 2 and 3, $CO_2$ gas will be vented directly to the actuation inlet 50 where it will act on the plunger 54 moving the valve into the sealing position shown in FIG. 3.

Of course, various other sensing means well known in the art could be used in combination with the valve of this invention. Such mechanical and electrical devices create signals which can be used directly to move the valve spool or to activate a solenoid or the like.

Various modifications and alterations of this invention will become obvious to those skilled in the art without departing from the scope and spirit of this invention. It is to be understood that this invention is not limited to the illustrative carbonation embodiment disclosed hereinbefore.

What is claimed is:

1. A carbonation system suitable for carbonating water and mixing said carbonated water with a syrup to provide a carbonated beverage comprising:

a carbonation tank having an outlet and an inlet;

a closed loop fluid circuit connecting the outlet and the inlet of the carbonation tank;

dispensing means operative to withdraw carbonated water from said closed loop fluid circuit and mix said carbonated water with a beverage syrup;

pumping means located within the closed loop fluid circuit and operative to continuously pump carbonated water from said outlet to said inlet;

means for sensing the level of carbonated water within the carbonation tank and generating a signal when the carbonated water level falls below a predetermined level;

a two-position spool valve disposed within said closed loop fluid system and having first and second operating positions, said valve normally being in said first position and allowing carbonated water to continuously recirculate through said fluid circuit, and in response to the signal from said sensing means to move said valve to a second closed position when said sensing means signals a depleted supply of carbonated water, the valve operating to admit a supply of fresh water to the conduit between the dispensing means and the carbonation tank while temporarily restricting the flow of carbonated water; and a source of carbon dioxide operative to furnish carbon dioxide to the carbonation chamber at an elevated pressure.

2. In a carbonation system comprising a carbonation tank having an outlet and an inlet; a closed loop fluid circuit interconnecting the outlet and inlet; dispensing means operative to withdraw carbonated water from said circuit and mix said carbonated water with a beverage syrup; pumping means within said circuit and operative to continuously pump carbonated water from said outlet to said inlet; means for sensing the level of carbonated water within said tank and generating a signal when the level falls below a predetermined point; and a source of carbon dioxide operative to furnish carbon dioxide to a carbonation chamber within said tank at an elevated pressure, a spool valve disposed within said circuit and comprising:

a valve body having a longitudinal bore therein, and a fluid outlet, a recirculating inlet and a fresh water inlet, all in fluid communication with said bore;

a spool adapted for movement within said bore, said spool being moveable between a first and a second position, said spool in the first position maintaining said outlet, said recirculating inlet and said fresh water inlet in fluid communication with said bore and, in the second closed position, restricting said recirculating inlet; and means operative to move said spool between said first and second positions in response to the signal generated by said level sensing means.

3. The valve of claim 2, further comprising spool biased sealing means located at one end thereof, said sealing means being adapted to normally seal the recycling inlet but said sealing means being adapted to temporarily withdraw from said inlet at a predetermined pressure while said spool remains in the second closed position.

4. The valve of claim 2, wherein a fluid inlet port in said valve body distal said recirculating port is adapted to admit a fluid pressure on the end of said spool distal said sealing means, said fluid serving to move said spool between said first and second positions.

5. The valve of claim 4, wherein the portion of said spool juxtaposed to the fluid inlet port has associated therewith a port adapted to bleed a portion of the fluidic pressure on said spool valve thereby allowing said valve to return to its first open position.

* * * * *